US010107097B1

(12) United States Patent
Sollami

(10) Patent No.: US 10,107,097 B1
(45) **Date of Patent: *Oct. 23, 2018**

(54) COMBINATION POLYCRYSTALLINE DIAMOND BIT AND BIT HOLDER

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 167 days.

This patent is subject to a terminal disclaimer.

(21) Appl. No.: 15/220,595

(22) Filed: Jul. 27, 2016

Related U.S. Application Data

(63) Continuation-in-part of application No. 14/719,638, filed on May 22, 2015, now Pat. No. 9,988,903, which is a continuation-in-part of application No. 13/801,012, filed on Mar. 13, 2013, now Pat. No. 9,039,099, application No. 15/220,595, which is a continuation-in-part of application No. 14/714,547, filed on May 18, 2015, now Pat. No. 9,518,464, and a continuation-in-part of application No. 14/487,493, filed on Sep. 16, 2014, now Pat. No. 9,909,416.

(60) Provisional application No. 61/716,243, filed on Oct. 19, 2012, provisional application No. 61/879,353, filed on Sep. 18, 2013, provisional application No. 62/237,070, filed on Oct. 5, 2015.

(51) Int. Cl.

| | |
|---|---|
| ***E21C 35/18*** | (2006.01) |
| ***E21C 35/19*** | (2006.01) |
| ***E21C 35/183*** | (2006.01) |
| ***E21C 25/10*** | (2006.01) |
| ***E01C 23/088*** | (2006.01) |

(52) U.S. Cl.
CPC ..... *E21C 35/19* (2013.01); *E01C 23/088* (2013.01); *E21C 25/10* (2013.01); *E21C 35/183* (2013.01); *E21C 2035/1813* (2013.01)

(58) Field of Classification Search
CPC ..... E21C 35/18; E21C 2035/1803; E21C 2035/1813
See application file for complete search history.

(56) References Cited

U.S. PATENT DOCUMENTS

| | | | |
|---|---|---|---|
| 3,397,012 | A | 8/1968 | Krekeler |
| 3,519,309 | A | 7/1970 | Engle |
| 3,865,437 | A | 2/1975 | Crosby |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — John J Kreck
(74) *Attorney, Agent, or Firm* — Mercedes V. O'Connor; Rockman Videbeck & O'Connor

(57) ABSTRACT

A combination bit and bit holder assembly includes a bit holder having a forward body portion and a shank. The forward body portion includes an upper end and a lower end. An insert is mounted in the bore of the upper end of the body portion. The insert also includes a central bore that receivingly retains a receiving cup. The receiving cup includes a bottom portion and an annular flange that extends from the bottom portion and defines a hollow forward portion. A bit is mounted in the hollow forward portion of the receiving cup which is configured to have a ductility that provides impact absorption to the bit.

22 Claims, 17 Drawing Sheets

(56) References Cited

U.S. PATENT DOCUMENTS 4,084,856 A 4/1978 Emmerich
4,247,150 A 1/1981 Wrulich et al.
4,310,939 A 1/1982 Iijima
4,453,775 A 6/1984 Clemmow
4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,694,918 A 9/1987 Hall
4,763,956 A 8/1988 Emmerich
4,811,801 A 3/1989 Salesky
4,818,027 A 4/1989 Simon
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,492,188 A 2/1996 Smith et al.
5,607,206 A 3/1997 Siddle
5,628,549 A 5/1997 Ritchey
5,725,283 A 3/1998 O'Neill
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,250,535 B1 6/2001 Sollami
6,331,035 B1 12/2001 Montgomery, Jr.
6,357,832 B1 3/2002 Sollami
6,371,567 B1 4/2002 Sollami
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader et al.
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 5/2015 Sollami
9,316,061 B2 4/2016 Hall
2002/0167216 A1 11/2002 Sollami
2003/0015907 A1 1/2003 Sollami
2003/0047985 A1 3/2003 Stiffler
2004/0004389 A1 1/2004 Latham
2004/0174065 A1 9/2004 Sollami
2006/0071538 A1 4/2006 Sollami
2006/0186724 A1 8/2006 Stehney
2008/0035386 A1 2/2008 Hall et al.
2009/0261646 A1 10/2009 Ritchie et al.
2010/0244545 A1 9/2010 Hall
2010/0253130 A1 10/2010 Sollami
2011/0006588 A1 1/2011 Monyak et al.

(56) References Cited

U.S. PATENT DOCUMENTS

| | | | |
|---|---|---|---|
| 2011/0089747 | A1 | 4/2011 | Helsel |
| 2011/0204703 | A1 | 8/2011 | Sollami |
| 2011/0254350 | A1 | 10/2011 | Hall |
| 2012/0027514 | A1 | 2/2012 | Hall |
| 2012/0068527 | A1 | 3/2012 | Erdmann |
| 2012/0181845 | A1 | 7/2012 | Sollami |
| 2012/0248663 | A1 | 10/2012 | Hall |
| 2012/0261977 | A1 | 10/2012 | Hall |
| 2012/0280559 | A1 | 11/2012 | Watson |
| 2012/0286559 | A1 | 11/2012 | Sollami |
| 2012/0319454 | A1 | 12/2012 | Swope |
| 2013/0169023 | A1 | 7/2013 | Monyak |
| 2014/0326516 | A1 | 11/2014 | Haugvaldstad |
| 2015/0028656 | A1 | 1/2015 | Sollami |
| 2015/0240634 | A1 | 8/2015 | Sollami |
| 2015/0285074 | A1 | 10/2015 | Sollami |
| 2015/0292325 | A1 | 10/2015 | Sollami |
| 2015/0300166 | A1 | 10/2015 | Ries et al. |
| 2015/0308488 | A1 | 10/2015 | Kahl |
| 2015/0315910 | A1 | 11/2015 | Sollami |
| 2015/0354285 | A1 | 12/2015 | Hall |
| 2016/0194956 | A1 | 7/2016 | Sollami |
| 2017/0089198 | A1 | 3/2017 | Sollami |

FOREIGN PATENT DOCUMENTS

| | | | |
|---|---|---|---|
| DE | 202012100353 | | 6/2013 |
| DE | 102015121953 | | 7/2016 |
| DE | 102016118658 | | 3/2017 |
| GB | 2483157 | | 2/2012 |
| WO | 2008105915 | A2 | 9/2008 |
| WO | 2008105915 | A3 | 9/2008 |
| WO | 2009006612 | | 1/2009 |

COMBINATION POLYCRYSTALLINE DIAMOND BIT AND BIT HOLDER

CROSS-REFERENCE TO RELATED APPLICATION(S)

This application claims priority to and is a continuation-in-part of U.S. Provisional Application No. 62/237,070, filed Oct. 5, 2015; this application claims priority to and is a continuation-in-part of U.S. Non-provisional application Ser. No. 14/719,638, filed May 22, 2015, U.S. Non-provisional application Ser. No. 14/719,638 claims priority to and is a continuation-in-part of U.S. Non-provisional application Ser. No. 13/801,012, filed Mar. 13, 2013, now U.S. Pat. No. 9,039,099, issued May 26, 2015, and U.S. Non-provisional application Ser. No. 13/801,012 claims priority to U.S. Provisional Application No. 61/716,243, filed Oct. 19, 2012; this application claims priority to and is a continuation-in-part of U.S. Non-provisional application Ser. No. 14/714,547, filed May 18, 2015, U.S. Non-provisional application Ser. No. 14/714,547 claims priority to and is a division of U.S. Non-Provisional application Ser. No. 13/801,012, filed Mar. 13, 2013, now U.S. Pat. No. 9,039,099, issued May 26, 2015, and U.S. Non-provisional application Ser. No. 13/801,012 claims priority to U.S. Provisional Application No. 61/716,243, filed Oct. 19, 2012; and this application claims priority to and is a continuation-in-part of U.S. Non-provisional application Ser. No. 14/487,493, filed Sep. 16, 2014, and U.S. Non-provisional application Ser. No. 14/487,493 claims priority to U.S. Provisional Application 61/879,353, filed Sep. 18, 2013, to the extent allowed by law and the contents of which are incorporated herein by reference in their entireties.

TECHNICAL FIELD

This disclosure relates to bit assemblies for road milling, mining, and trenching equipment, and more particularly, to combinations of bit and bit holders having polycrystalline diamond cutting tools as a forward leading tip of the bit retained by a steel cup.

BACKGROUND

Originally, road milling equipment was utilized to smooth out bumps in the surface of a roadway or to grind down the joinder of two adjacent concrete slabs that may have buckled. Later these road milling machines, operated with a cylindrical drum having a plurality of bit blocks mounted thereon in herringbone or spiral fashion, and bit holders with bits on top thereof in turn mounted on the bit blocks, have been utilized for completely degrading concrete and macadam roads down to their gravel base. The road milling equipment can also be used for trenching and mining operations.

Bits, such as those shown in U.S. Pat. No. 6,739,327 ('327), disclose an insert having a conical cutting tip that is mounted in a recess in a frustoconical forward portion of the bit. The insert 88 is surrounded by a hardened annular collar that provides added wear resistance to the cutting tool. The tool has a solid generally cylindrical shank extending axially rearwardly from the body portion.

The bit as described in the '327 patent fits in a central bore in a bit holder as described in U.S. Pat. No. 6,371,567 and U.S. Pat. No. 6,585,326. The above-described bit holders, being frictionally seated in bores in their respective bit blocks mounted on drums, and not held therein by retaining clips or threaded nuts, provide for ease of removal and replacement when the bit holders are worn through use or broken due to the harsh road degrading environment that they are used in.

Additionally, it has been found that individual bits may wear or be broken off of their shanks because of the harsh use environment and need replacement. Historically, these bits and bit holders have been made of steel with hardened tungsten carbide tips or collars to lengthen their end use service time.

Recently, materials harder than tungsten carbide, i.e., polycrystalline diamond such as shown in U.S. Pat. No. 8,118,371 ('371), have been used in certain road milling operations, notably the degradation of asphalt layers on long roadway stretches. While the hardness of the polycrystalline diamond tip lengthens the useful life of the combined bit and bit holder shown in the '371 patent, such that the bit does not have to be removable from the bit holder, the combination includes a somewhat brittle polycrystalline diamond tip that is not suitable for use in degrading concrete highways or curved highway stretches, such as cloverleafs and the like.

A need has developed for the provision of a polycrystalline diamond structured combination bit and bit holder that is sturdy enough to withstand the forces found when degrading or breaking up the surfaces of not only macadam (asphalt) roadways but also concrete roadways.

SUMMARY

This disclosure relates generally to bit assemblies for road milling, mining, and trenching equipment. One implementation of the teachings herein is a combination bit and bit holder that includes a shank having an elongate generally cylindrical member and an annular groove extending axially inwardly from a distal end of the bit holder, the annular groove defining an interior surface of an annular outer sidewall between approximately ⅛ and ½ inch in thickness; an enlarged diameter body extending forwardly of the shank, where the body is configured to receive a bit; an insert mounted in a forward end of the body of the bit holder; a receiving cup mounted in the insert; and a bit having a polycrystalline diamond (PCD) coated bit tip, the bit mounted in the receiving cup, where the receiving cup is configured to have a ductility that provides impact absorption to the bit.

In another implementation of the teachings herein is a bit/bit holder that includes a body of rounded shape having an upper end and a lower end, wherein the upper end is diametrically smaller than the lower end, and wherein a substantial portion of the body is solid; a generally cylindrical shank extending from the lower end of the body, wherein the shank is hollow and includes at least one axially oriented elongate slot through a sidewall of the shank; a bore axially extending through the upper end of the body, the bore including an annular declining taper sidewall; an insert having a central cylindrical bore extending axially inwardly from a top of the insert and a complementary declining taper sidewall for matingly fitting in the annular declining taper sidewall of the bore of the upper end, wherein the top of the insert extends outwardly from the bore of the upper end, and wherein the insert is retained within the bore of the upper end to form a unitary structure with the body; a receiving cup mounted in the central cylindrical bore of the insert; and a bit having a polycrystalline diamond (PCD) coated distal tip, wherein the bit is mounted in the receiving cup.

In yet another implementation of the teachings herein is a bit/bit holder that includes a body of rounded shape having an upper end and a lower end, wherein the upper end is diametrically smaller than the lower end and wherein a substantial portion of the body is solid; a generally cylindrical shank extending from the lower end of the body, wherein the shank is hollow and includes at least one axially oriented elongate slot through a sidewall of the shank; an insert mounted in a bore axially extending in the upper end of the body; and a receiving cup mounted in the insert, the receiving cup configured to receive a bit and have a ductility that provides impact absorption to the bit.

In yet another implementation of the teachings herein is a tip assembly that includes a diamond coated tungsten carbide tip; a ductile metal receiving cup comprising a thick bottom portion and an annular flange extending upwardly from a circumference of the thick bottom portion, the annular flange defining a hollow forward portion of the receiving cup configured to receive the tip; and a tungsten carbide insert configured to receivingly retain the receiving cup.

In yet another implementation of the teachings herein is a unitary bit/bit holder that includes a steel holder comprising a body portion and a shank portion extending from the body portion; the body portion comprising an axially extending annular flange defining a forwardmost portion; the annular flange comprising an outwardly tapered inner surface; a reverse tapered tungsten carbide insert comprising a forward end having a recess, the insert complementarily affixed in an interior of the annular flange; a receiving cup comprising a thick bottom portion and an annular flange extending upwardly from a circumference of the thick bottom portion, the annular flange defining a hollow forward portion of the receiving cup, the receiving cup affixed in the recess of the insert; and a diamond coated tip affixed to the hollow forward portion of the receiving cup, the receiving cup configured to provide greater interference between both the tip and the receiving cup and the receiving cup and the insert than the interference between the tip and the insert alone.

In yet another implementation of the teachings herein is a tool that includes a metal body having a top portion and a shank depending from a distal end of the top portion; a ring mounted on a forward end of the top portion; an insert extending through the ring and mounted in the top portion of the metal body; and a receiving cup mounted in the insert, the receiving cup configured to receive a bit and have a ductility that provides impact absorption to the bit.

In yet another implementation of the teachings herein is a combination bit and bit holder that includes a body portion comprising a first bore extending axially inwardly from a forward end of the body portion of the bit holder; a generally cylindrical hollow shank depending axially from the body portion, the shank comprising a slot axially extending from a distal end of the shank toward the body portion; a tool comprising a metal body having a top portion and a tool shank depending from a distal end of the top portion; a ring mounted on a forward end of the top portion; an insert extending through the ring and mounted in the top portion of the metal body; and a receiving cup mounted in the insert, the receiving cup configured to receive the bit and have a ductility that provides impact absorption to the bit; and wherein the tool shank is mounted in the first bore of the body portion of the bit holder.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Road milling, mining, and trenching equipment utilizes bits traditionally set in a bit assembly having a bit holder, comprising a bit holder body and a shank, and a bit holder block. The bit is retained by the bit holder and the shank of the bit holder is retained within a bore in the bit holder block. The combinations of bit assemblies have been utilized to remove material from the terra firma, such as degrading the surface of the earth, minerals, cement, concrete, macadam or asphalt pavement. Individual bits, bit holders, and bit holder blocks may wear down or break over time due to the harsh road degrading environment. Tungsten carbide and diamond or polycrystalline diamond coatings, which are much harder than steel, have been used to prolong the useful life of bits and bit holders. Bit holder blocks, herein after referred to as base blocks, are generally made of steel. Forces, vibrations, and loose abrasive materials exerted on the bit assemblies may cause the shank and the bit holder to wear away the bore of the base block. The bit is retained within a steel cup to provide added ductility and cushion the bit holder from repeated hammer blows received at the diamond coated bit tip. The added ductility provided by the steel cup allows the combination bit and bit holder to be used in removing Macadam, concrete, and other hardened and non-homogenous materials, thereby widening the field of use and prolonging the useful life of the combination bit and bit holder.

Figure 1:
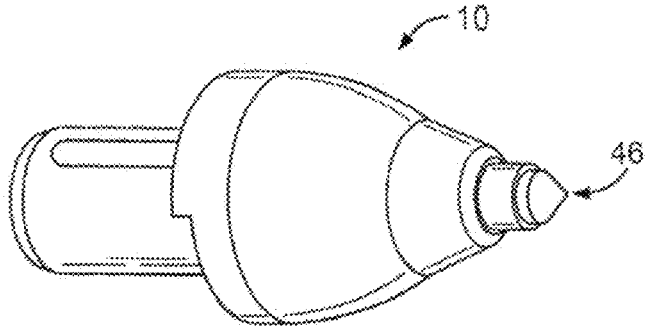
FIG. 1 is a front ¼ perspective view of a first embodiment of a combination bit and bit holder, showing a conical polycrystalline diamond tip.
Figure 2:
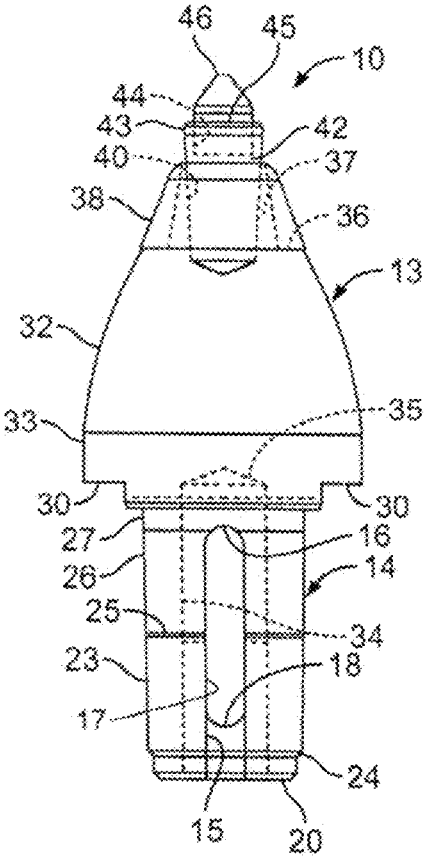
FIG. 2 is a front elevation view of the first embodiment of the combination bit and bit holder of FIG. 1.
Figure 3:
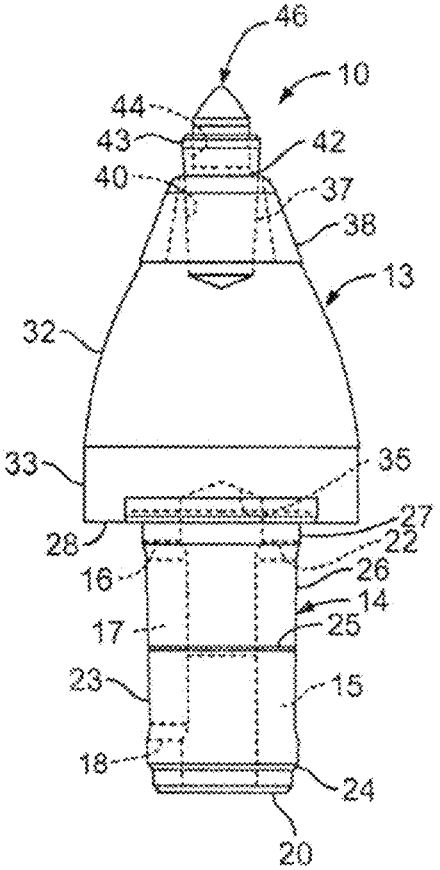
FIG. 3 is a side elevation view of the first embodiment of the combination bit and bit holder of FIG. 1.
Figure 4:
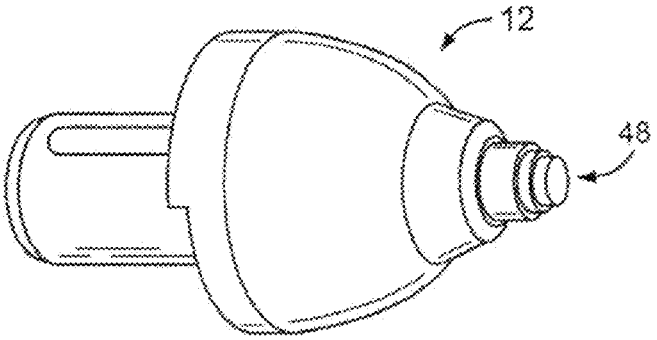
FIG. 4 is a front ¼ elevation perspective view of a modification of the first embodiment of the combination bit and bit holder, showing a flat top cylindrical polycrystalline diamond tip.

Referring to FIGS. 1-6, a first embodiment of a bit holder 10 and a first modification of a bit holder 12 of the present disclosure are shown in perspective view in FIGS. 1 and 4, respectively. The combination bit and bit holder of the present disclosure is a unitary bit and bit holder construction that includes a bit holder body 13, 13*a* (FIGS. 1-3, FIGS. 4-6) generally constructed in accordance with the teachings of U.S. Pat. No. 6,585,326, and a generally cylindrical hollow shank 14. In the first embodiment and the first modification, the shank 14 includes an elongate first slot 15 extending from a generally annular distal end 20 of the shank 14 axially upward or forward to an upper termination 16 adjacent the upper or forward end of the shank 14. In these embodiments, the shank 14 also includes an internally oriented second slot 17 located approximately 180 degrees around the annular shank 14 from the first slot 15. This second slot 17, first disclosed in U.S. Pat. No. 6,685,273, is parallel to the first slot 15 and is an internal slot having a rearward semicircular termination 18 inwardly adjacent to the distal end 20 of the shank 14 and a forward semicircular termination 22 generally coinciding longitudinally and axially with the upper termination 16 of the first slot 15.

In this first embodiment, the shank 14 preferably includes a lower or first tapered portion 23 running axially from a stepped shoulder 24 adjacent the distal end 20 of the shank 14. The first tapered portion 23 runs upwardly or axially from the stepped shoulder 24 of the shank 14 and terminates generally mid slot 15 longitudinally. The shank 14 also includes an annular shoulder 25 separating the lower tapered portion 23 from an upper or second tapered portion 26 which extends from the shoulder 25 generally to the top of the shank 14 or forward terminations of slot 15 and slot 17. A generally cylindrical upper portion 27 of the shank 14 extends from a position adjacent the top or upper termination of slot 15 and slot 17 towards a generally annular back flange 28 that denotes the base of the bit holder body 13, 13*a* of the bit holder 10, 12.

In the illustrated first embodiment of bit holder 10, the generally annular flange 28 includes a pair of horizontal slots 30-30 generally perpendicular to the longitudinal axis of the combination bit/bit holder, one on either side of the generally annular flange 28. The horizontal slots 30-30 are configured to receive a pair of bifurcated fork tines that may be inserted between the base of the body portion 13 of the bit holder 10 and a base block (not shown) into which the shank 14 of the bit/bit holder combination is inserted and retained by outward radial force in use.

In this first illustrated embodiment, the bit holder body 13 includes an enlarged upper body 32 having a generally cylindrical base 33, termed in the trade as a tire portion, and a cylindrical side wall extending upwardly approximately ½ inch from the base 33 to the generally convex surfaced upper body 32. The enlarged upper body 32 of the bit holder body 13, in this embodiment, is a generally convex surfaced solid structure. In other embodiments, the enlarged upper body 32 can have various shapes, such as having a generally frusto-conical, concave, or arcuate surfaced solid structure.

In this first illustrated embodiment, a central bore 34 longitudinally and axially extending through the shank 14 of the bit holder body 13, 13*a* of the bit/bit holder combination terminates at bore termination 35 that is approximately at the upper end of the shank 14. This allows the generally C-shaped annular side wall of the shank 14 to radially contract when the shank 14 is mounted in one of a tapered or cylindrical bore in a base block (not shown).

In this first illustrated embodiment, the bit holder body 13, 13*a* of the bit/bit holder combination provides added bulk and strength to the entire unitary assembly which allows the bit/bit holder combination of the present disclosure to withstand substantial forces and stress superior to heretofore known bit holders or bit/bit holder combinations. The present disclosure may be utilized not only in the degrading and removal of macadam or asphalt from long straight stretches of roadway, but may also provide for the removal of concrete and other materials both in straight long stretches and in curved sections such as at corners, cloverleaf intersections, or the like. Also, the flat top design is less expensive to make and is a readily available part stocked by many suppliers. Such commercially available products are the subject matter of U.S. Pat. Nos. 5,355,969 and 8,169,634, the contents of which are incorporated herein by reference.

Adjacent the top of the illustrated first embodiment and first modification of the present disclosure, shown in FIGS. 1-6, the generally convex sided bit holder body 13, 13*a* has a generally flat annular top surface 36 therearound positioned perpendicular to the axis of the bit holder 13, 13*a* from the interior of which axially extends a smaller radially oriented annular tapered upper or forward extension 37. Around this tapered upper extension 37 is fitted an annular tungsten carbide ring 38 which may preferably be braised into unitary construction with the remainder of the bit holder. The top or forwardmost portion of the tungsten carbide ring 38 and the annular tapered upper extension 37 of the upper body portion terminate generally at the top of the bit holder body 13, 13*a* of the combination bit/bit holder.

With the bit holder body 13, 13*a* of the present disclosure preferably made of 4340 or equivalent steel, the top of the upper extension 37 of the upper body 32 includes a generally cylindrical or radially declining tapered bore 40 extending from the co-terminal upper wall of the body axially inwardly thereof which defines, in this illustrated embodiment, a declining radial taper. The tapered bore 40 extends a short distance longitudinally axially inwardly of the annular extension 37 that defines the base for the tungsten carbide protective ring 38. Bore 40 can also have a hollow cylindrical shape or a slight draw or draft angle.

The generally cylindrical or declining tapered bore 40 provides a space for receiving a complementary shaped positive generally cylindrical or declining tapered outer surface of a solid base insert 42 for the bit/bit holder combination. The base insert 42 for the bit also extends upwardly and is tapered outwardly axially longitudinally from the co-terminal upper extension 37 of the bit holder body 13, 13*a* and includes an upper annular ring portion 43 which, in this embodiment, is made of tungsten carbide. In other embodiments, the base insert 42 can extend upwardly and be generally cylindrical or have a slight draft angle.

Figure 11:
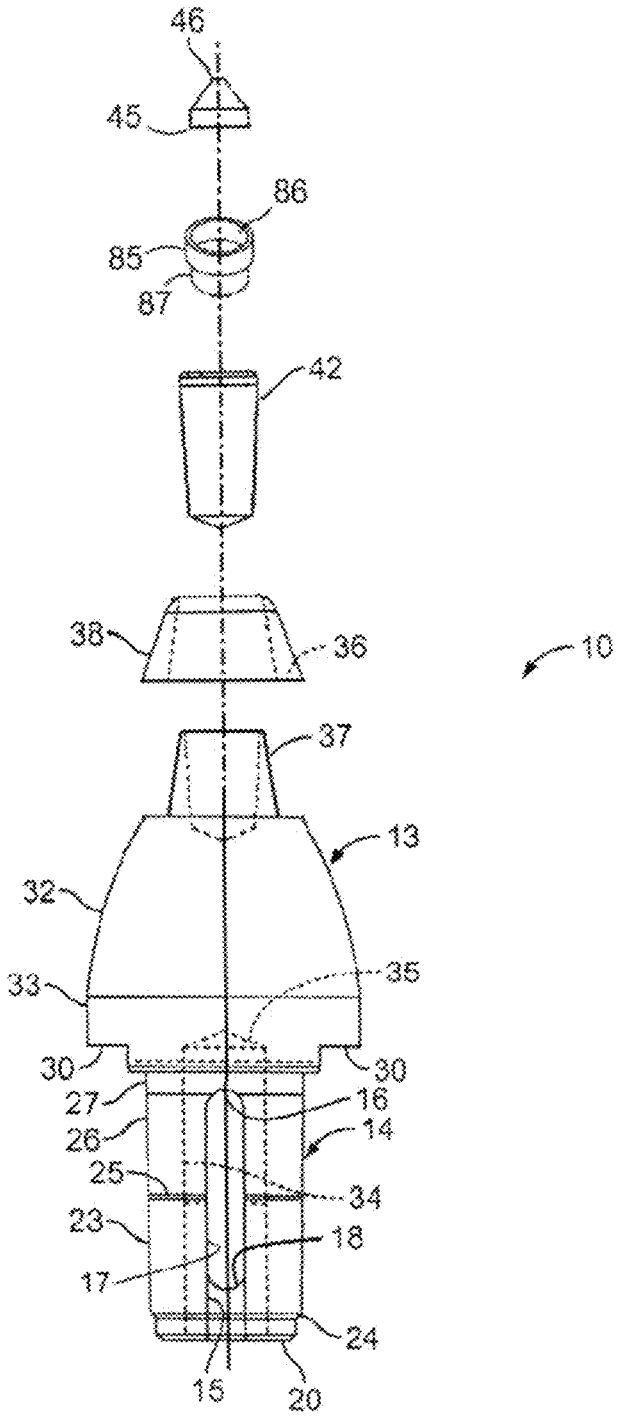
FIG. 11 is an exploded front elevation view of the first embodiment of the combination bit and bit holder of FIG. 1, showing a steel cup, into which the diamond coated tip is inserted, which is in turn inserted into the forward end of the reverse taper insert.
Figure 12:
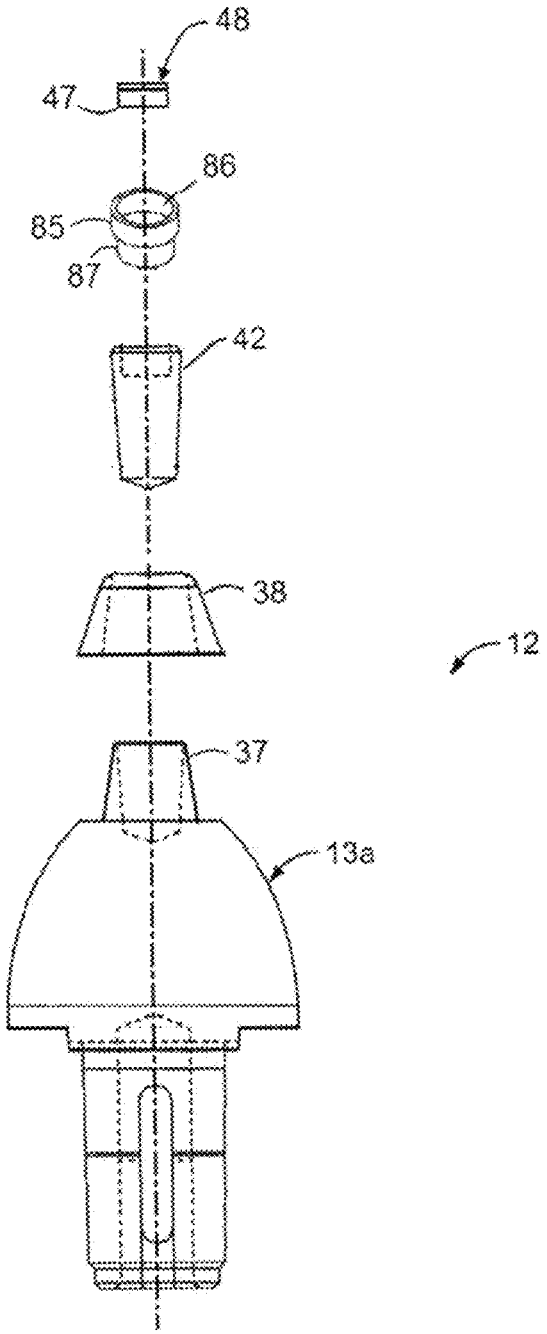
FIG. 12 is an exploded front elevation view of the modification of the first embodiment of the combination bit and bit holder of FIG. 4, showing a steel cup, into which the diamond coated tip is inserted, which is in turn inserted into the forward end of the reverse taper insert.

In the first embodiment and the first modification, the top portion of the bit base insert 42 includes a generally cylindrical bore 44 positioned centrally therein into which a receiving cup 85, shown in FIGS. 11 and 12, may be positioned and braised therein. In this embodiment, the receiving cup 85 is made of steel and is about ⅜-1 inch in height. The receiving cup 85 includes a thick bottom portion 87 and a hollow cup forward portion 86 into which a tip base 45 of a bit tip 46, shown in FIG. 11, and a tip base 47 of a bit tip 48, shown in FIG. 12, may be positioned and braised therein to provide a unitary structure. In other embodiments, the receiving cup 85 may have a thin bottom portion and a hollow cup forward portion. The tip base 45, 47 may be made of steel or tungsten carbide and includes a tip at the outer or upper end of the bit tip. In this embodiment, the outer surface or upper end of tip 46, 48 is made of a polycrystalline diamond structure. The tip 46 can have a frustoconical shape, as sown in FIGS. 1-3, or the tip 48 can have a flat generally cylindrical puck shape, as shown in the first modification in FIGS. 4-6. The upper end of the bit tip 46, 48 may also be made of an industrial diamond material and may be a coating or outer layer of such industrial diamond material, natural diamond, or polycrystalline diamond (PCD) material. The coating or layer may be formed of a high pressure, high temperature process.

The reasoning behind the addition of the cup-shaped thick bottom 87 of the receiving cup 85 relates to the ductility of the steel versus the non-ductility of the tungsten carbide ring portion 43 of the base insert 42. Using the solid steel receiving cup 85 allows the ductility of the thick bottom portion 87 to cushion the repeated hammer blows received at the diamond coated tip 46, 48. The added ductility to the tip 46, 48 of the bit allows the combination bit and bit holder to be used not only in removing Macadam, but also in removing concrete and other hardened and non-homogenous materials, thereby providing added life and a widened field of use for the combination bit and bit holder over previously known diamond coated bits. Additionally, the tungsten carbide to steel to tungsten carbide sequence of the present disclosure yields substantially stronger bonds than brazing tungsten carbide to tungsten carbide alone.

The conical tip 46, shown in FIGS. 1-3, is of the type which has been used in degrading straight long stretches of asphalt or macadam and which is sufficiently brittle not to be used in more strenuous applications such as degrading concrete and degrading curved sections of highway surface construction. The present unitary bit/bit holder of the present disclosure overcomes such limitations.

Figure 5:
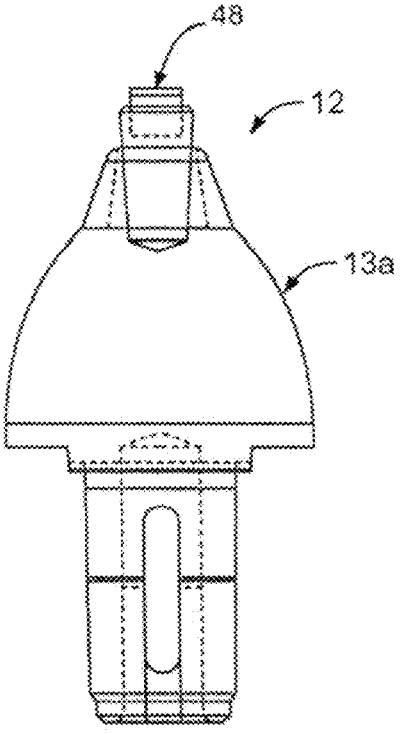
FIG. 5 is a front elevation view of the modification of the first embodiment of the combination bit and bit holder of FIG. 4.
Figure 6:
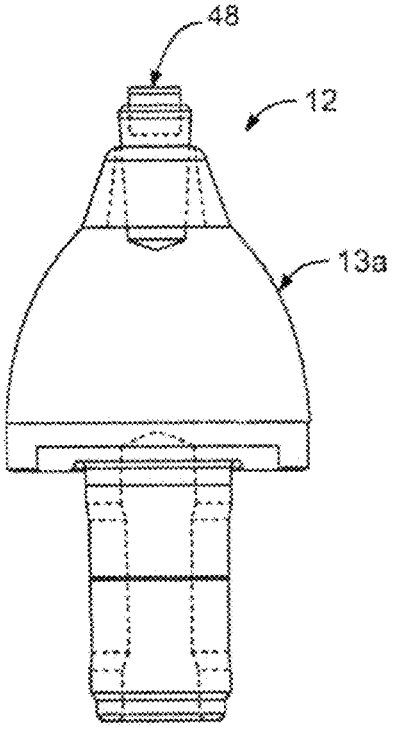
FIG. 6 is a side elevation view of the modification of the first embodiment of the combination bit and bit holder of FIG. 4.
Figure 8B:
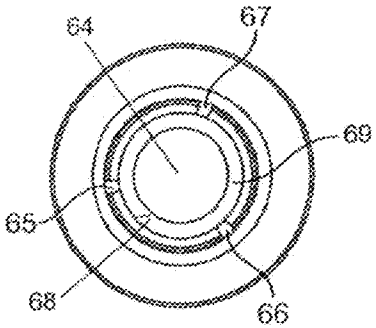
FIG. 8*b* is a bottom plan view of the second embodiment of the combination bit and bit holder of FIG. 8*a;*
Figure 8A:
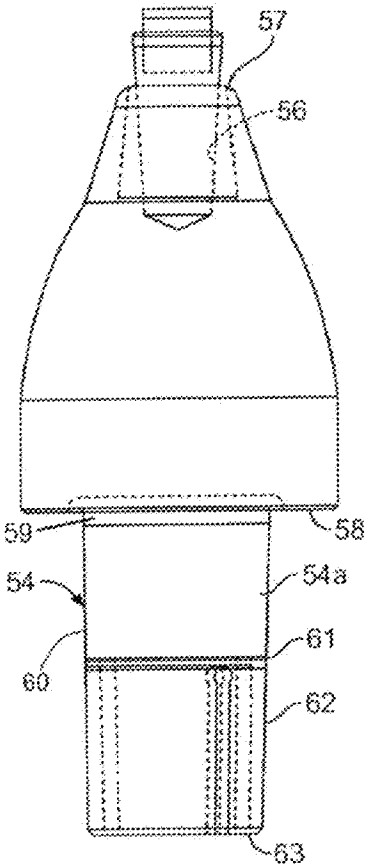
FIG. 8*a* is a side elevation view of the second embodiment of the combination bit and bit holder of FIGS. 7*a* and 7*b;*
Figure 7A:
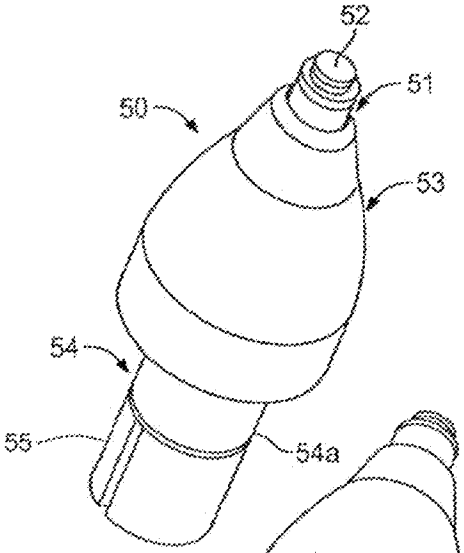
FIG. 7*a* is a ¾ top perspective view of a second embodiment of the combination bit and bit holder, showing a trepanned shank distal end having three longitudinally spaced slots.
Figure 7B:
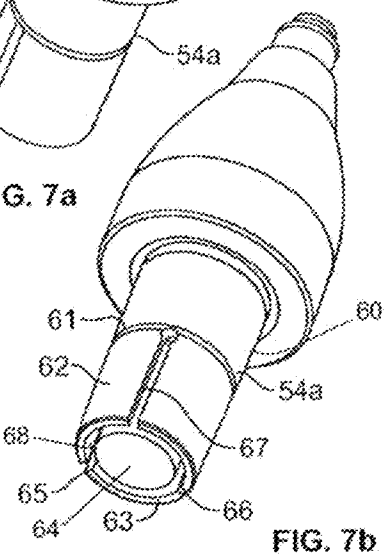
FIG. 7*b* is a ¾ bottom perspective view of the second embodiment of the combination bit and bit holder, showing the longitudinally slotted trepanned shank.

The flat generally cylindrical puck shaped tip 48 of the bit of the first modification of the bit holder 12, shown in FIGS. 4-6, provides a substantially stronger tip that is able to withstand the added forces and peak jolts found in degrading concrete and the like, and together with the added bulk of the bit holder body 13*a* of the illustrated bit/bit holder combination in FIGS. 4-6, is capable of removing or degrading concrete surfaces with the added life expectancy shown in prior bit/bit holder constructions with PCD tips that have heretofore been utilized only in removing long straight stretches of macadam. The receiving cup 65 holding the puck-shaped tip 48 is also an impact absorbing member that can stretch and compress without fracturing. A road milling machine can travel faster with forward speed using the instant bit/bit holders than it can with bit holders having a strictly tungsten carbide forward end. The remainder of the first modification is identical to the first embodiment.

A second embodiment of a bit holder 50 of the present disclosure, shown in FIGS. 7*a*, 7*b*, 8*a* and 8*b*, includes a bit 51, tip 52 and bit holder body 53 that is similar to that shown in FIGS. 4-6. A shank 54 of the bit/bit holder combination provides an important aspect of the present disclosure. In the second embodiment of bit holder 50, an outer surface of a sidewall 54*a* of the shank 54 is substantially similar to that shown in FIGS. 1-6, with the exception that a distal first tapered portion 62 of the shank 54 includes three evenly spaced slots 65, 66, 67 longitudinally formed axially through the sidewall 54*a*. It should be noted that the first tapered portion 62 may be constructed with either a slight taper of one degree, or less, or down to a cylindrical (no-taper) configuration. The second embodiment may include more or fewer slots.

In this second embodiment, not only is the generally frustoconical or convex side wall of the bit holder body 53 solid in construction, with the exception of a bore 56 for mounting the bit 51 at a forward end 57 thereof, the shank 54 that extends from a generally annular flange 58 of the bit holder body 53 is also largely solid in construction. Similar to the first embodiment of bit holder 10, the upper or forward portion of the shank 54, adjacent the generally annular flange 58 of the body portion, includes a generally cylindrical portion 59 that axially extends towards a second tapered portion 60. The second tapered portion 60 extends axially from the border of the cylindrical portion 59 to a shoulder portion 61 that extends radially outwardly of the base of the second tapered portion 60 and defines the top of the first tapered portion 62 which in turn extends axially to a distal end 63 of the shank 54.

As indicated previously, this first tapered portion 62 may include a taper of about 1 degree, or less, down to having a cylindrical outer surface. Whereas the shank 14 in the first embodiment, shown in FIGS. 1-6, was hollow at its center, the shank 54 of the second embodiment is solid at its center core 64 from the bit holder body 53 to a distal end 63 of the shank 54. The first tapered portion 62, which in this embodiment includes the three equally spatially circumferentially related longitudinal slots 65, 66, 67, defines a generally annular ring with the exception of the equally spaced slots 65, 66, 67. This slightly radially inwardly deformable first tapered portion 62 has an inner annular surface 68 defined by a trepanned or hole saw type groove 69 extending inwardly of the shank 54 from the distal end 63 to the top of the first tapered portion 62. The depth of the trepanned groove 69 may be varied to obtain the proper performability of the sidewall and the number of slots may be varied depending on the design parameters desired. This annular trepanned groove 69 is formed to provide a side wall for the first tapered portion 62 having a thickness which may vary from about ⅛ inch to about ½ inch, in this illustrated embodiment, depending upon the desired elastic flexibility of the side wall of the first tapered portion 62.

In construction, the trepanned groove 69 is a less expensive forming operation than is the bore 34 found in the first embodiment and first modification of bit holder 10, 12 of FIGS. 1-6, although the center portion of the shank may be removed if desired. Additionally, the trepanned groove 69 leaves the center core 64 of the shank 54 intact in the illustrated second embodiment to provide a stronger overall construction for the combination bit/bit holder. Further, with the additional mass of the bit holder portion of the bit/bit holder combination, the entire bit holder may be made of less expensive steel than is necessary for the first embodiment and first modification of bit holder 10, 12 shown in FIGS. 1-6. Generally, steels of the type 4140 may be utilized for construction of the second embodiment of the present disclosure.

Figure 13:
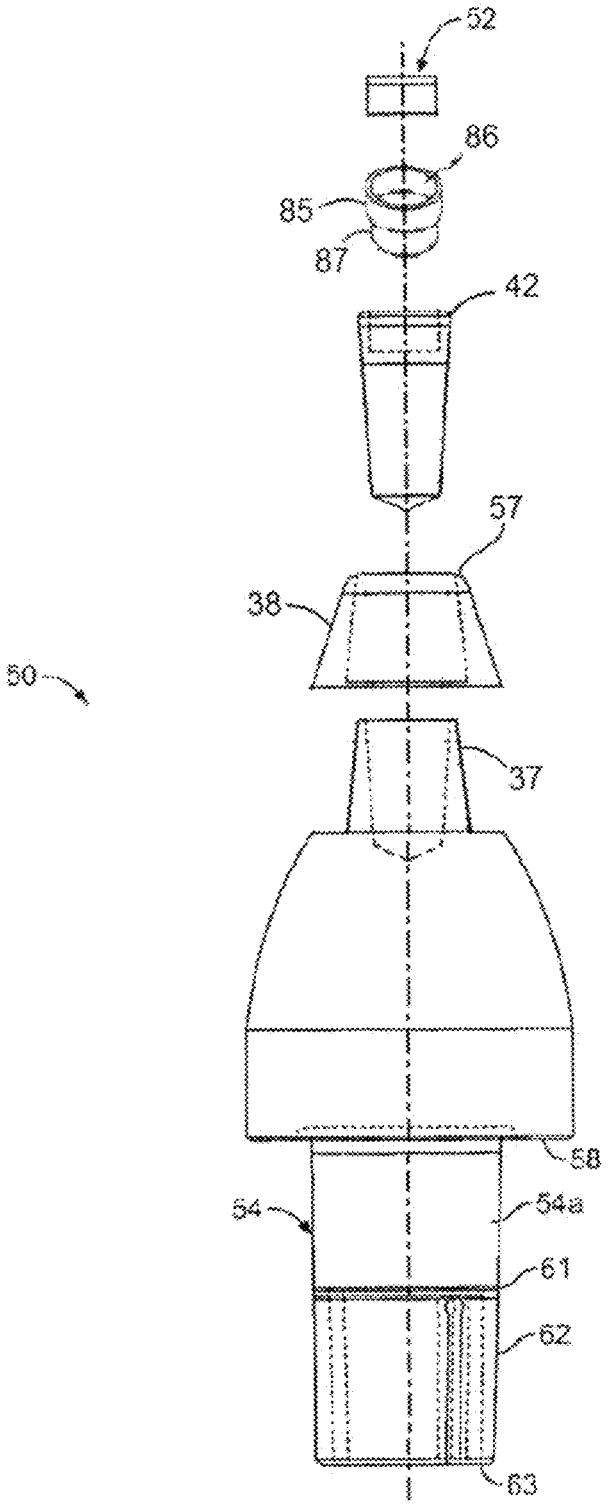
FIG. 13 is an exploded front elevation view of the second embodiment of the combination bit and bit holder of FIGS. 7*a* and 7*b*, showing a steel cup, into which the diamond coated tip is inserted, which is in turn inserted into the forward end of the reverse taper insert.

As described in the first embodiment and the first modification, and for similar reasons, the top portion of the bit base insert 42 in the second embodiment includes a generally cylindrical bore 44 positioned centrally therein into which a receiving cup 85, shown in FIG. 13, may be positioned and braised therein. In this embodiment, the receiving cup 85 is made of steel and is about ⅜-1 inch in height. The receiving cup 85 includes a thick bottom portion 87 and a hollow cup forward portion 86 into which tip 52 may be positioned and braised therein to provide a unitary structure. In other embodiments, the receiving cup 85 may have a thin bottom portion and a hollow cup forward portion. In this embodiment, the outer surface or upper end of tip 52 is made of a polycrystalline diamond structure and has a flat generally cylindrical puck shape. The upper end of the bit tip 52 may also be made of an industrial diamond material and may be a coating or outer layer of such industrial diamond material, natural diamond, or polycrystalline diamond (PCD) material. The coating or layer may be formed of a high pressure, high temperature process.

Figure 9A:
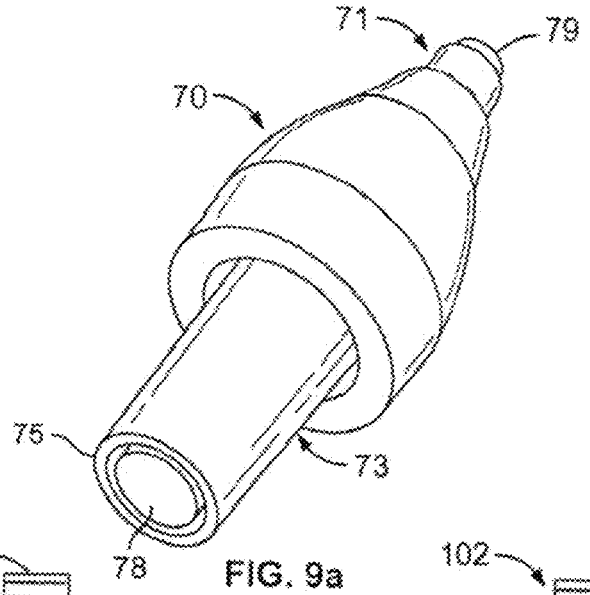
FIG. 9*a* is a bottom ¾ perspective view of a third embodiment of the combination bit and bit holder, showing a trepanned shank.
Figure 9B:
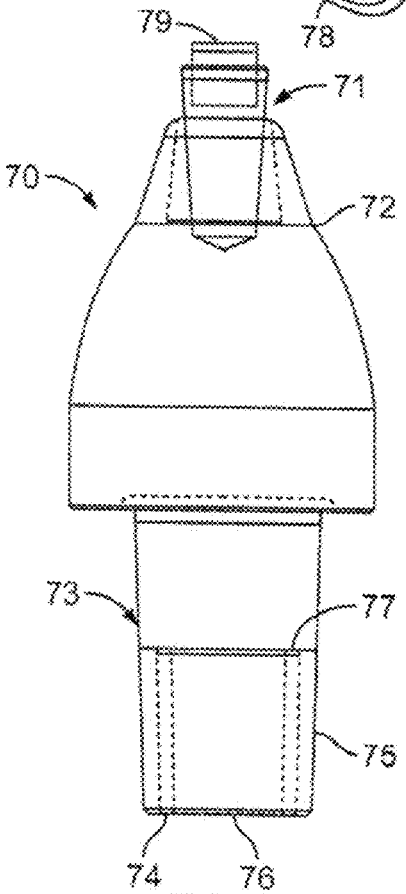
FIG. 9*b* is a side elevation view of the third embodiment of the combination bit and bit holder of FIG. 9*a;*

A third embodiment of a bit holder 70 of the present disclosure, shown in FIGS. 9*a* and 9*b*, includes a combined bit 71, tip 79 and bit holder body 72 that is identical to that shown in FIGS. 7*a*, 7*b*, 8*a* and 8*b*. The difference between the third embodiment of bit holder 70 and the second embodiment of bit holder 50 is in the trepanned first tapered portion and slots of the shank shown in the second embodiment. Similar to the second embodiment of bit holder 50, the third embodiment of bit holder 70 includes an annular trepanned groove 74 that extends axially inwardly in a first tapered portion 75 of a shank 73 from a distal end 76 of the shank 73 generally to a shoulder portion 77 at a top of the first tapered portion 75.

The difference between the second embodiment and the third embodiment is that the third embodiment does not include the slots shown in the second embodiment. The thickness of the outer side wall of the annular first tapered portion 75 (which may also be cylindrical) will be thinner than that disclosed in the second embodiment of bit holder 50 shown in FIGS. 7*a*, 7*b*, 8*a* and 8*b* and may be on the order of 1/16 to ¼ inch wall thickness for the embodiment shown in FIGS. 9*a* and 9*b*, having a nominal 1½ inch outer diameter. As a result, while the typical interference fit for severe or extreme uses such as concrete degradation might have a solid shank interference of 0.001 to 0.003 of an inch thickness for the nominal 1½ inch diameter shank, the interference fit for the thin side wall in the trepanned first tapered portion 75 of the shank 73 in the third embodiment of bit holder 70 would approximate two to four times the previously mentioned interference fit.

With such a fit, the shank side wall may wrinkle when a shank is inserted in a base block bore. Again, the third embodiment of bit holder 70 shown in FIGS. 9*a* and 9*b* would be less expensive to manufacture than even the second embodiment of bit holder 50 shown in FIGS. 7*a*, 7*b*, 8*a* and 8*b*. In this third embodiment of bit holder 70, a core or central portion 78 of the shank 73 may be left intact, or removed, and the combination of that mass in the shank 73 together with the solid upper body 72 and integrally formed bit 71 braised thereon provides a structure which can be utilized to degrade not only macadam or asphalt but also concrete pavement.

Figure 14:
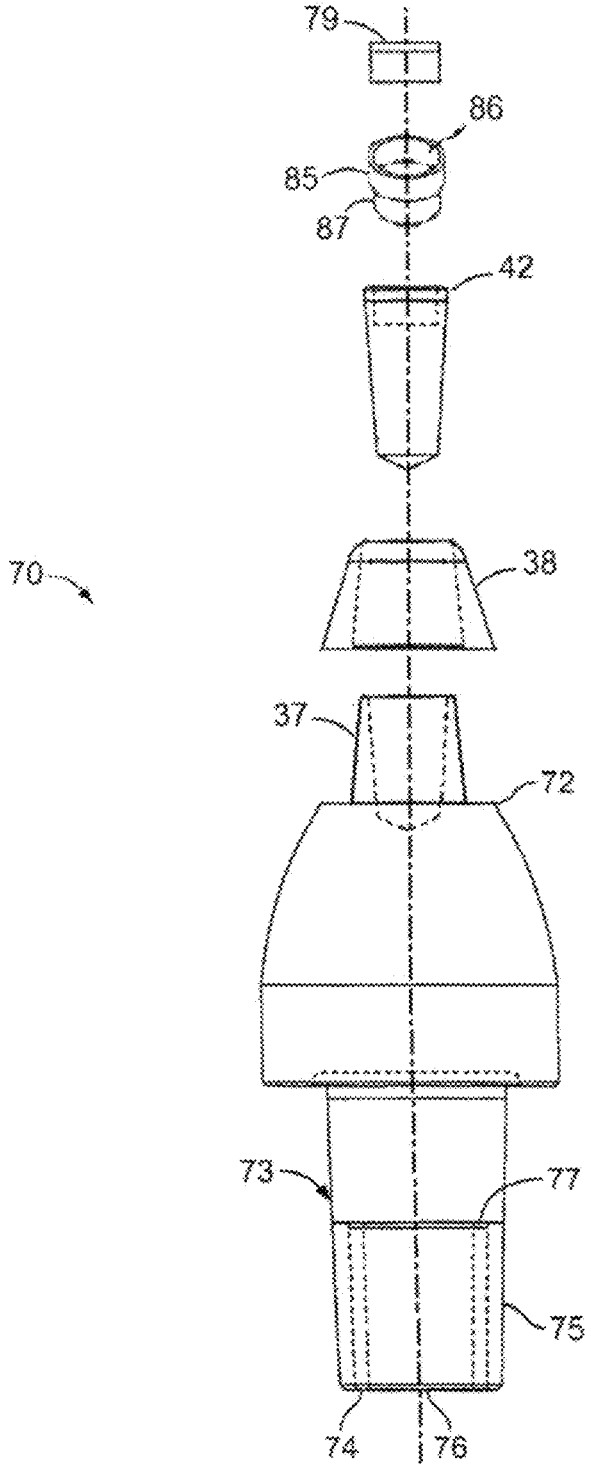
FIG. 14 is an exploded front elevation view of the third embodiment of the combination bit and bit holder of FIG. 9*a*, showing a steel cup, into which the diamond coated tip is inserted, which is in turn inserted into the forward end of the reverse taper insert.

As described in the first embodiment, the first modification, and the second embodiment, and for similar reasons, the top portion of the bit base insert 42 in the third embodiment includes a generally cylindrical bore 44 positioned centrally therein into which a receiving cup 85, shown in FIG. 14, may be positioned and braised therein. In this embodiment, the receiving cup 85 is made of steel and is about ⅜-1 inch in height. The receiving cup 85 includes a thick bottom portion 87 and a hollow cup forward portion 86 into which tip 79 may be positioned and braised therein to provide a unitary structure. In other embodiments, the receiving cup 85 may have a thin bottom portion and a hollow cup forward portion. In this embodiment, the outer surface or upper end of tip 79 is made of a polycrystalline diamond structure and has a flat generally cylindrical puck shape. The upper end of the bit tip 79 may also be made of an industrial diamond material and may be a coating or outer layer of such industrial diamond material, natural diamond, or polycrystalline diamond (PCD) material. The coating or layer may be formed of a high pressure, high temperature process.

The use of the flat puck shaped polycrystalline bit tip, the bit/bit holder combination provides added use life for the structure and sturdiness thereof which would be superior to the bit and bit holder combinations heretofore known. The shorter use life for a tungsten carbide tipped bit has resulted in a design necessity of allowing the bit to be removed and replaced numerous times prior to replacing the bit holder.

Figure 10:
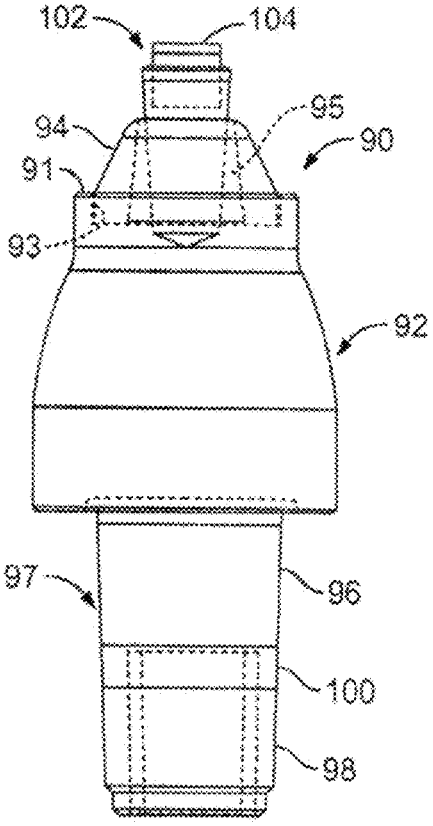
FIG. 10 is a side elevation view of a fourth embodiment of the combination bit and bit holder.

A fourth embodiment of a bit holder 90 of the present disclosure, shown in FIG. 10, includes a combined bit 102, tip 104 and bit holder body 92 that is similar to the prior embodiments disclosed herein with two differences. First, in order to provide superior brazing of the tungsten carbide ring to the forward end of the bit holder, a forwardly extending annular collar 91 is created on the bit holder body 92 to provide an annular trough 93 around a tapered upper extension 95 of the bit holder body 92 onto which the annular ring 94 is mounted. The vertical outer wall of the trough 93 will keep brazing material from flowing outwardly of the joinder between the base of the ring 94 and the annular flange on which the ring 94 is positioned. After the brazing is complete, the outer portion of the trough may be left as is, or may be removed and generally conformed to a shape similar to that shown in FIGS. 1-6.

The second difference between the fourth embodiment of bit holder 90 and the preceding embodiments is an annular cylindrical outer wall portion 96 adjacent the top of a first tapered portion 98 of a shank 97 of the bit holder 90. When it has been determined that the design parameters for the outward forces at the first tapered portion 98 of the shank 97 have been met utilizing less than the whole available surface area, an annular cylindrical area 100 may be formed adjacent the upper end of the first tapered portion 98 that keeps that area from contacting the base block bore (not shown). The axial width of the cylindrical band 100 may be varied to meet the desired design criteria.

Figure 15:
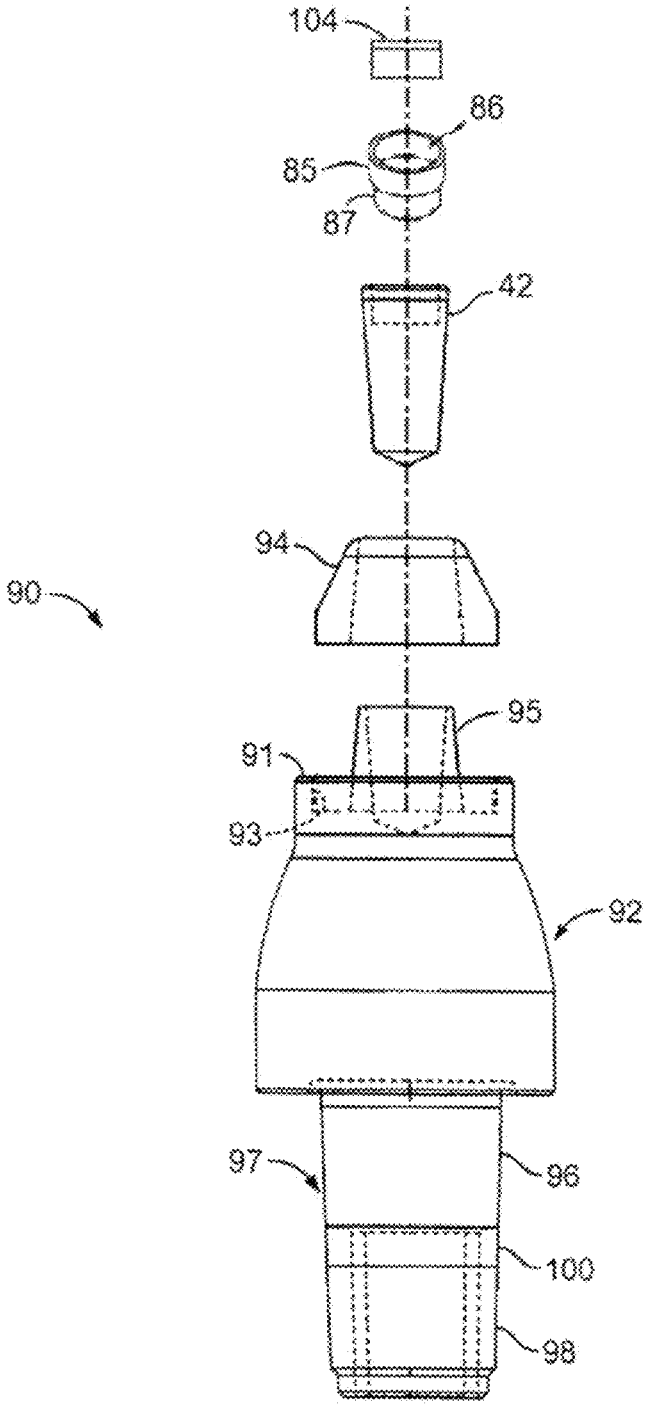
FIG. 15 is an exploded front elevation view of the fourth embodiment of the combination bit and bit holder of FIG. 10, showing a steel cup, into which the diamond coated tip is inserted, which is in turn inserted into the forward end of the reverse taper insert.
Figure 16:
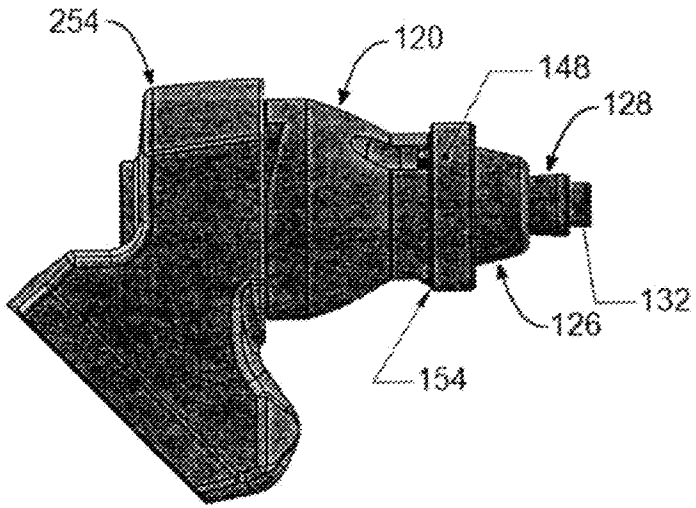
FIG. 16 is a side elevation view of a fifth embodiment of the combination bit and bit holder, shown inserted into a bit holder block.

As described in the first embodiment, the first modification, the second embodiment, and the third embodiment, and for similar reasons, the top portion of the bit base insert 42 in the fourth embodiment includes a generally cylindrical bore 44 positioned centrally therein into which a receiving cup 85, shown in FIG. 15, may be positioned and braised therein. In this embodiment, the receiving cup 85 is made of steel and is about ⅜-1 inch in height. The receiving cup 85 includes a thick bottom portion 87 and a hollow cup forward portion 86 into which tip 104 may be positioned and braised therein to provide a unitary structure. In other embodiments, the receiving cup 85 may have a thin bottom portion and a hollow cup forward portion. In this embodiment, the outer surface or upper end of tip 104 is made of a polycrystalline diamond structure and has a flat generally cylindrical puck shape. The upper end of the bit tip 104 may also be made of an industrial diamond material and may be a coating or outer layer of such industrial diamond material, natural diamond, or polycrystalline diamond (PCD) material. The coating or layer may be formed of a high pressure, high temperature process.

Figure 23:
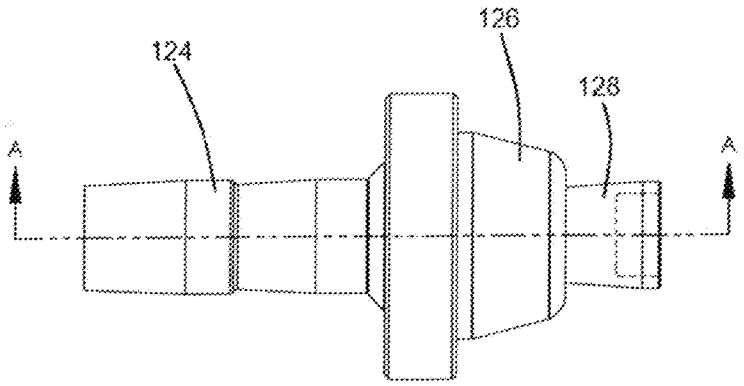
FIG. 23 is a side elevation view of the fifth embodiment of the combination bit and bit holder, showing the assembled tool.
Figure 24:
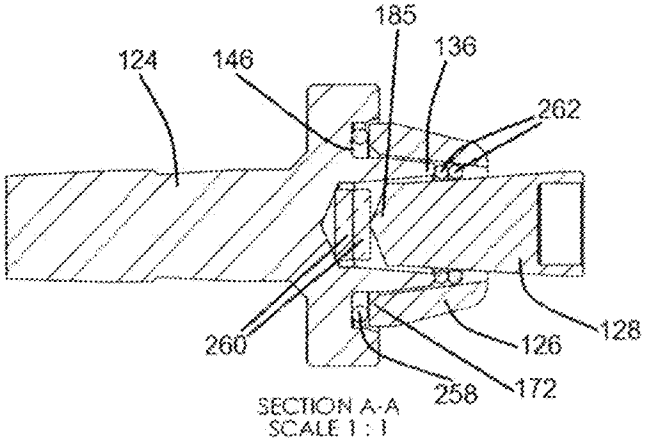
FIG. 24 is a cross-sectional side plan view, taken along line A-A of FIG. 23, of the fifth embodiment of the combination bit and bit holder, showing the tool, brazing disks, and brazing rings when assembled prior to the first brazing process.
Figure 25:
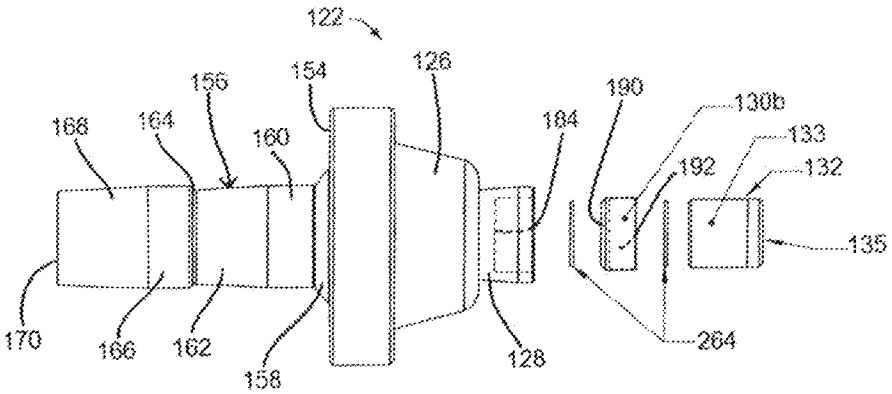
FIG. 25 is an exploded top elevation view of the fifth embodiment of the combination bit and bit holder, showing the brazing disks.

A fifth embodiment of the combination bit and bit holder of the present disclosure, shown in FIGS. 16-26, includes a bit holder 120 and a tool or bit 122. The tool 122 includes a tool body 124, a ring 126, an insert 128, a cup 130, and a hardened tip 132. In this embodiment, the tool body 124 and the cup 130 are made of steel while the ring 126 and the insert 128 are made of tungsten carbide. In this embodiment, the hardened tip 132 includes a tungsten carbide substrate or base 133 and a diamond material coating or layer 135, as shown in FIG. 25, such as an industrial diamond material, natural diamond, or polycrystalline diamond coating or layer.

Figure 19:
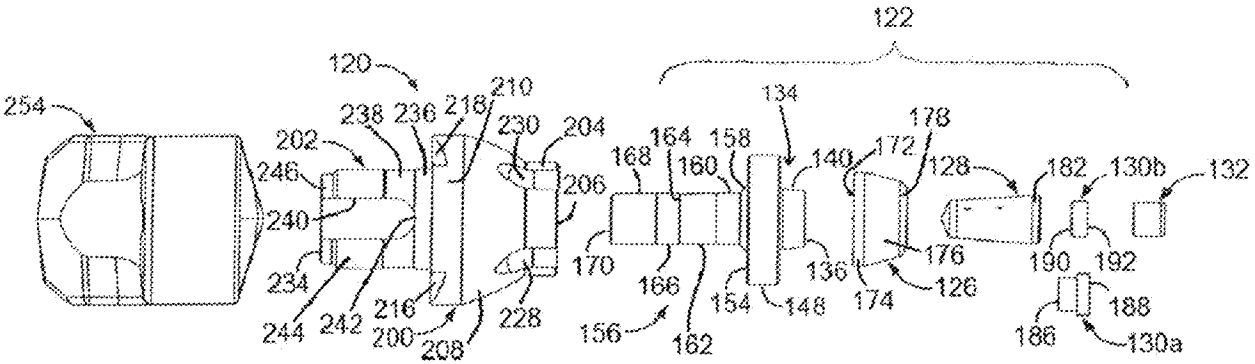
FIG. 19 is an exploded top elevation view of the fifth embodiment of the combination bit and bit holder, showing the bit holder block.
Figure 20:
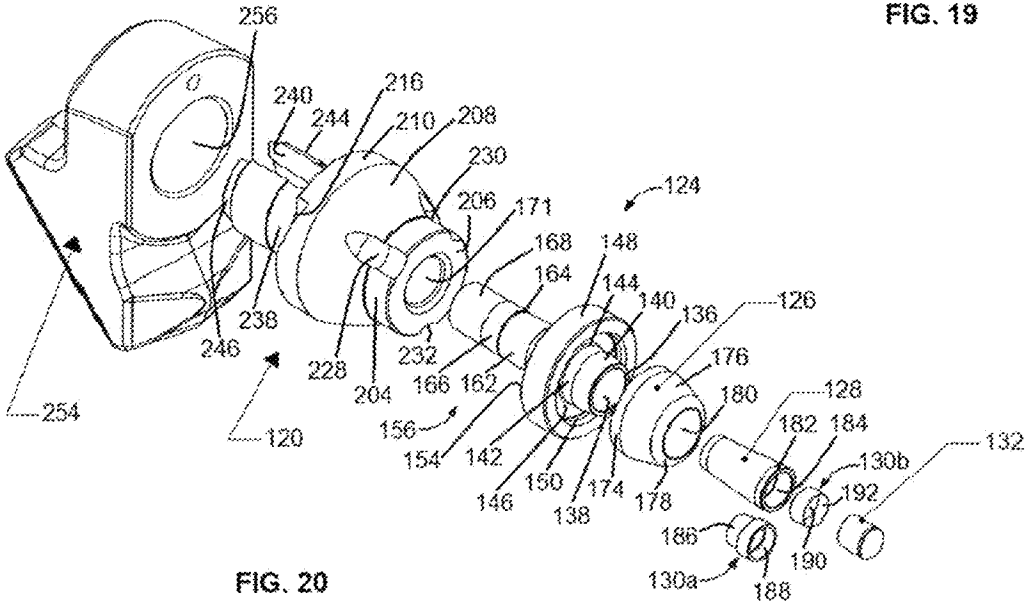
FIG. 20 is an exploded perspective view of the fifth embodiment of the combination bit and bit holder, showing the bit holder block.
Figure 21:
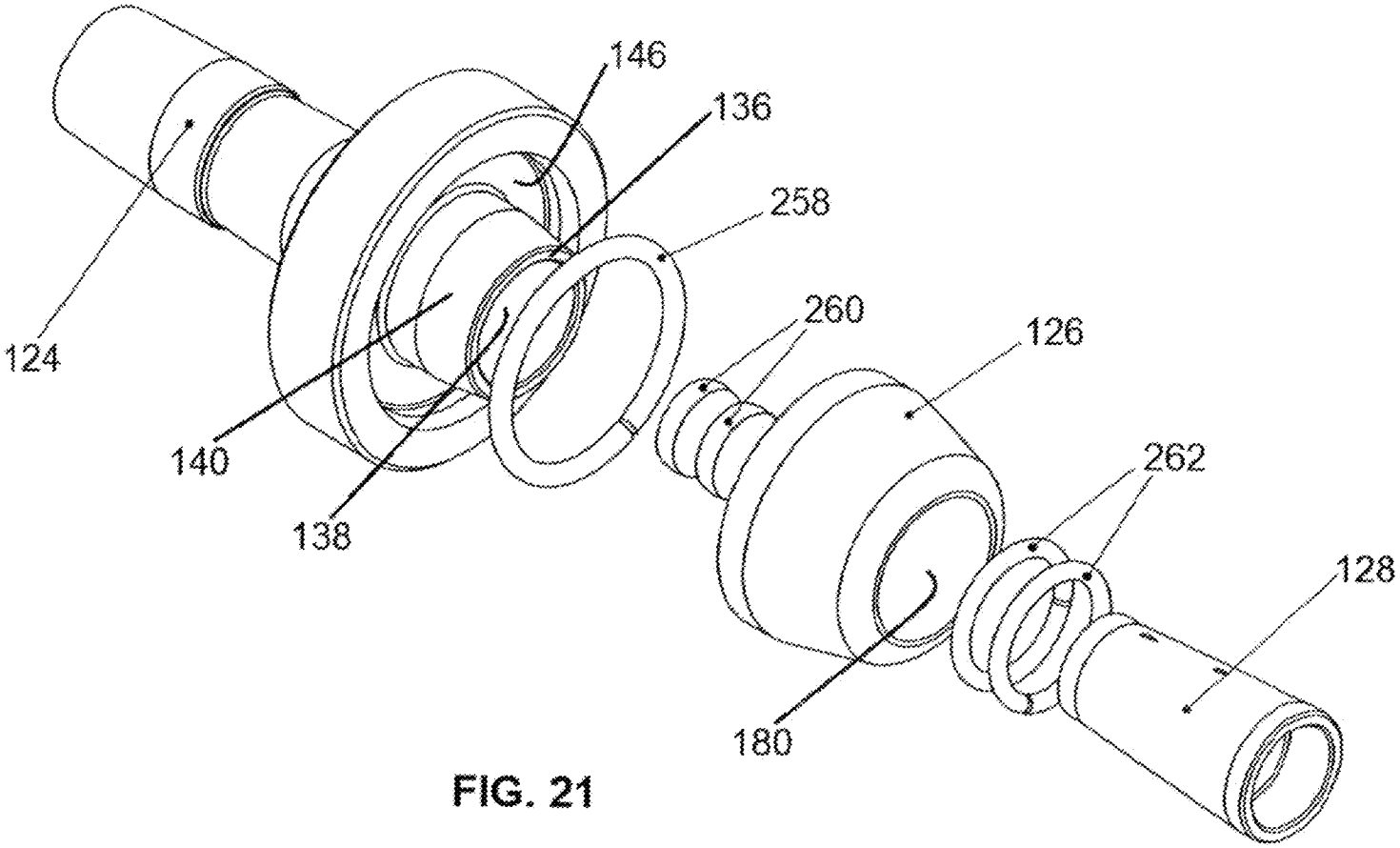
FIG. 21 is an exploded perspective view of the fifth embodiment of the combination bit and bit holder, showing the brazing disks and the brazing rings.
Figure 22:
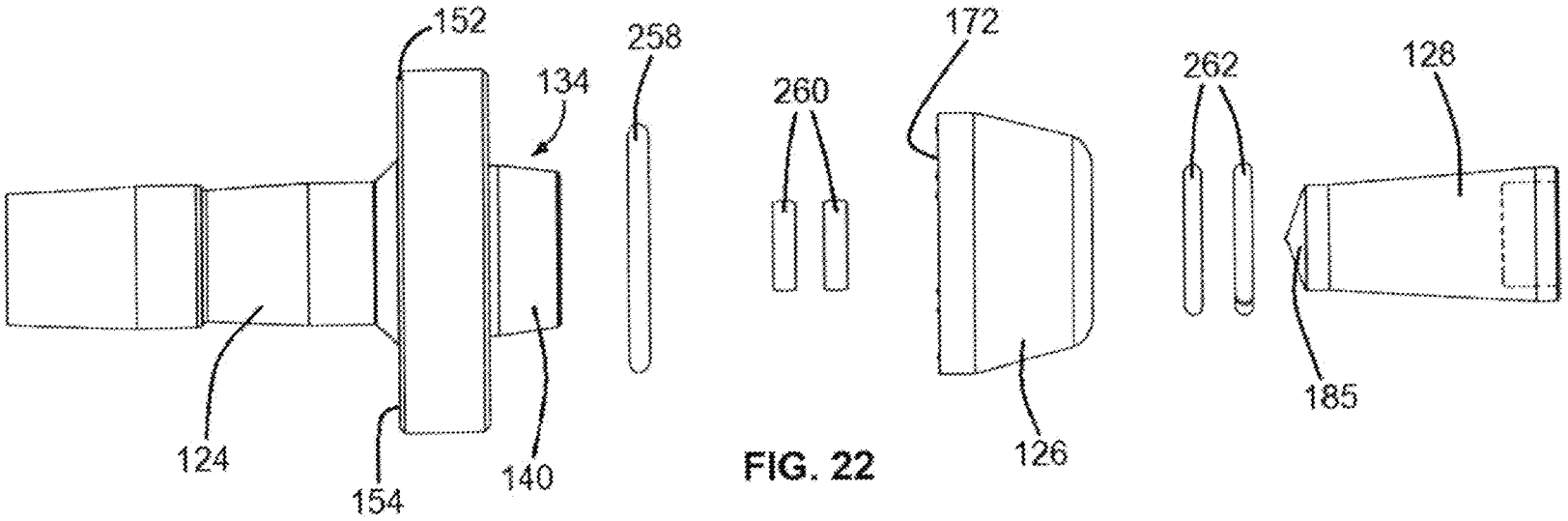
FIG. 22 is a side elevation view of the fifth embodiment of the combination bit and bit holder, showing the brazing disks and the brazing rings.

Referring to FIGS. 19-21, the tool body 124 includes a top portion 134 having an annular uppermost surface 136 with a central bore 138 extending axially inwardly part way along the length of the top portion 134. The top portion 134 includes a tapered first section 140 that extends downwardly and outwardly to a generally cylindrical second portion 142. A frustoconical base 144 of the top portion 134 extends downwardly and outwardly to an annular trough 146 in a tire portion 148, or washer portion, i.e. the largest outer diameter portion, of the tool 122. The annular trough 146, which has a substantially flat annular bottom, radially extends from the frustoconical base 144 to a vertical annular wall 150 of the tire portion 148. The tire portion 148 is generally solid and extends downwardly to a chamfer 152, shown in FIG. 22, that defines the outside of a rear annular flange 154.

Figure 26:
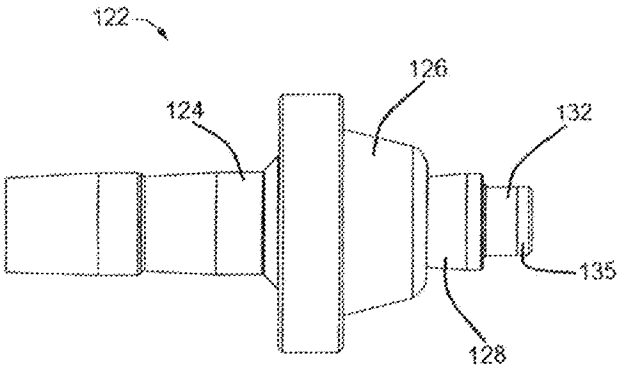
FIG. 26 is a side elevation view of the fifth embodiment of the combination bit and bit holder, showing the tool after the final brazing process.

Referring to FIGS. 19, 25, and 26, axially descending from the rear annular flange 154 is a tool shank 156. The tool shank 156 includes a tapered first segment 158, subjacent the rear annular flange 154, that axially extends downwardly and inwardly to a generally cylindrical second segment 160. A tapered third segment 162 axially extends from the second segment 160 to a shoulder 164. A generally cylindrical fourth segment 166 axially extends from the shoulder 164 to a tapered fifth segment 168 adjacent a distal end 170 of the tool shank 156. In other embodiments, the segments of the tool shank may be any combination of generally cylindrical segments, tapered segments, and/or segments with a slight draft angle.

The protective ring 126 is positioned or mounted adjacent the top portion 134 of the tool body 124. The ring 126 includes an annular bottom flange 172 having a generally cylindrical side surface 174, a tapered extending sidewall 176 and a tapered upper portion 178. In this embodiment, the tapered extending sidewall 176 tapers radially inward and axially extends to the tapered upper portion 178 which has a greater inward taper than sidewall 176. The ring 126 also includes a bore 180 that axially extends from the tapered upper portion 178 to the annular bottom flange 172 and that is matingly complementary to the top portion 134 of the tool body 124 above the tire portion 148. The annular bottom flange 172 of the ring 126 fits in the annular trough 146 of the tire portion 148 of the tool body 124.

As shown in FIGS. 19 and 20, the ring 126 is sized to be fitted on and brazed to the top portion 134 of the tool body 124. The insert 128 is positioned or mounted in the bore 180 of the ring 126 and is then fitted (brazed) into the bore 180 of the ring 126. The insert 128 provides added stiffness to the center of the tool body 124 while adding strength and toughness to the central part of the top portion 134 of the tool body 124.

The insert 128 extends upwardly and is tapered outwardly axially longitudinally from the upper portion 178 of the ring 126 and includes an upper annular ring portion 182. In other embodiments, the base insert 128 can extend upwardly and be generally cylindrical or have a slight draft angle. The top portion of the insert 128 further includes a generally cylindrical bore 184, positioned centrally in the insert 128, into which the cup 130 may be positioned and braised therein. In this embodiment, the insert 128 can receive cup **130*a* or cup 130*b*, as shown in FIGS. 19 and 20. The cup 130*a* is made of steel and is about ⅜-1 inch in height. The cup 130*a* includes a thick bottom portion 186 and a hollow cup forward portion 188 into which the base 133 of hardened tip 132 may be positioned and braised therein to provide a unitary structure. The cup 130***b* is also made of steel and includes a thin bottom portion 190 and a hollow cup forward portion 192 into which the base 133 of hardened tip 132 may be positioned and braised therein to provide a unitary structure. The tip 132 can have a frustoconical shape or a flat generally cylindrical puck shape, as shown in FIGS. 16-20, 25 and 26. The upper end of the bit tip 132 may also be made of an industrial diamond material and may be a coating or outer layer 135 of such industrial diamond material, natural diamond, or polycrystalline diamond (PCD) material. The coating or layer may be formed of a high pressure, high temperature process.

The steel cup 130 provides better attachment in carbide braised to steel than the attachment in carbide braised to carbide. The benefits of positioning the metal cup, whether made of brass or made of steel, between the tungsten carbide surfaces of the diamond tool are three-fold. One, steel or brass materials adhere more strongly to braze materials than carbide to carbide brazed joints. Two, the coefficient of thermal expansion of steel or brass materials is significantly greater than the coefficient of thermal expansion of tungsten carbide. This second feature allows for greater impact through the working end of the diamond tool without failure. Third, steel will heat more quickly and transfer heat more evenly in an induction magnetic field causing the PCD diamond insert to be more evenly heated without damage to the PCD coating on the top surface of its carbide insert. The PCD overlay coating on the insert in an open atmosphere has a maximum ideal temperature rating of 1300° F.

The tool 122 is assembled using a two step brazing process, as shown in FIGS. 21-26. In preparation for the first brazing process, a brazing ring 258 is positioned and mounted into the annular trough 146 and two brazing discs 260 are positioned and mounted in the central bore 138 of the top portion 134 of the tool body 124. The ring 126 is positioned and mounted adjacent the top portion 134 such that the annular bottom flange 172 rests on the brazing ring 258. Two smaller brazing rings 262 are positioned and mounted in the bore 180 of the ring 126 such that the brazing rings 262 rest on the annular uppermost surface 136 of the tool body 124. The insert 128 is then inserted through the bore 180 of the ring 126 and is positioned and mounted into the bore 138 of the tool body 124 such that the distal end 185 of the insert 128 rests on the brazing discs 260. The assembled tool 122, shown in FIGS. 23 and 24, is then ready for the first brazing process. In the first brazing process, the ring 126 and the insert 128 are brazed in one step at a brazing temperature between 1750° F. and 2000° F. Once the tool has cooled, the tool is heat treated, hardened and/or tempered to a hardness of RC 40-50.

Referring to FIG. 25, after the tool has been heat-treated, hardened and/or tempered, a brazing disc 264 is positioned and mounted in the bore 184 of the insert 128. In the embodiment shown in FIG. 25, the receiving cup 130*b* is positioned and mounted in the bore 184 of the insert 128 such that the bottom portion 190 rests on the brazing disc 264. Another brazing disc 264 is then positioned and mounted in the hollow cup forward portion 192 of the receiving cup 130*b*, which provides a tungsten carbide-steel-tungsten carbide sandwich that, when brazed together, is stronger than the combination of brazing the tungsten carbide insert directly to the tungsten carbide substrate of the hardened tip. The hardened tip 132 is then positioned and mounted in the hollow cup forward portion 192 of the receiving cup 130*b* such that the base 133 of the tip 132 rests on the brazing disc 264. Brazing discs 264 are liquidus below 1250° F. The fully assembled tool, shown in FIG. 26, is then ready for the second brazing process. In the second brazing process, the receiving cup 130 and hardened tip 132 are brazed in a single brazing operation.

The finished tool 122 can be used in any quick change bit holder and quick change base block. In this implementation of the fifth embodiment, the bit holder 120 includes a bit holder body 200 and a bit holder shank 202, shown in FIGS. 19, 19A, and 20, axially depending from the bottom of the bit holder body 200. The bit holder body 200 is generally annular in shape and comprises a generally cylindrical upper body portion 204 axially extending from a flat annular top surface 206. Subjacent the upper body portion 204 is a middle portion 208 that extends axially and radially outwardly to a radially extending generally cylindrical tire portion 210. In this embodiment, the middle portion 208 has an arcuate shape. In other embodiments, the middle portion 208 can have a frustoconical shape, a convex shape, or a concave shape.

Figure 18:
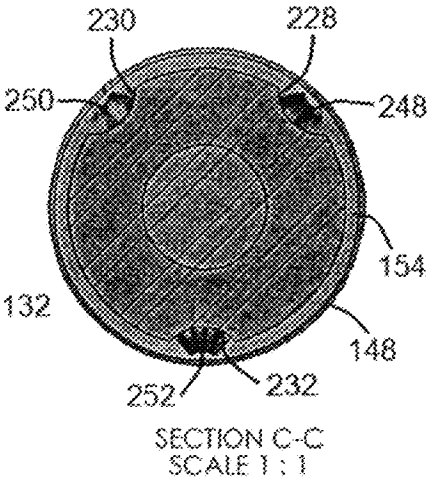
FIG. 18 is a cross-section view of the fifth embodiment of the combination bit and bit holder, the cross-section taken along line C-C of FIG. 17.
Figure 17:
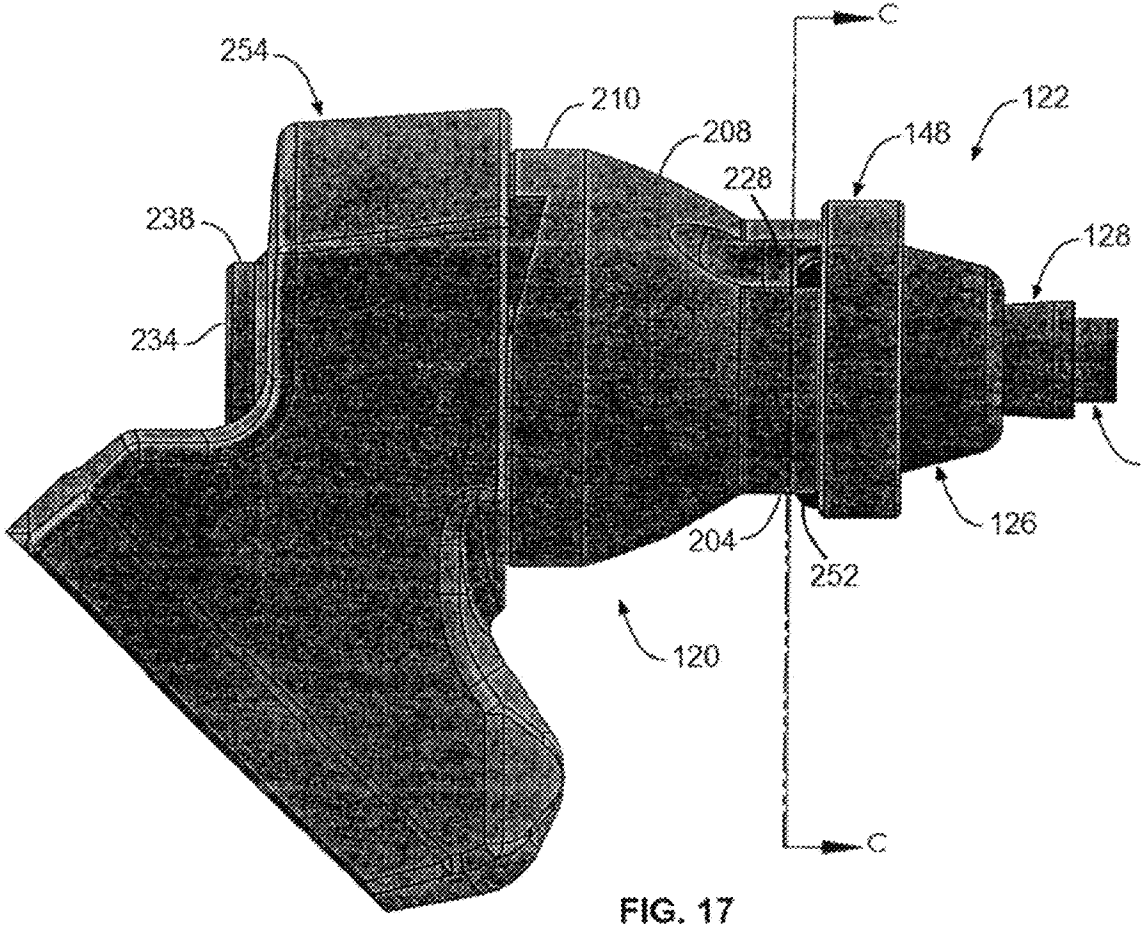
FIG. 17 is a side elevation view of the fifth embodiment of the combination bit and bit holder, shown inserted into the bit holder block.
Figure 19A:
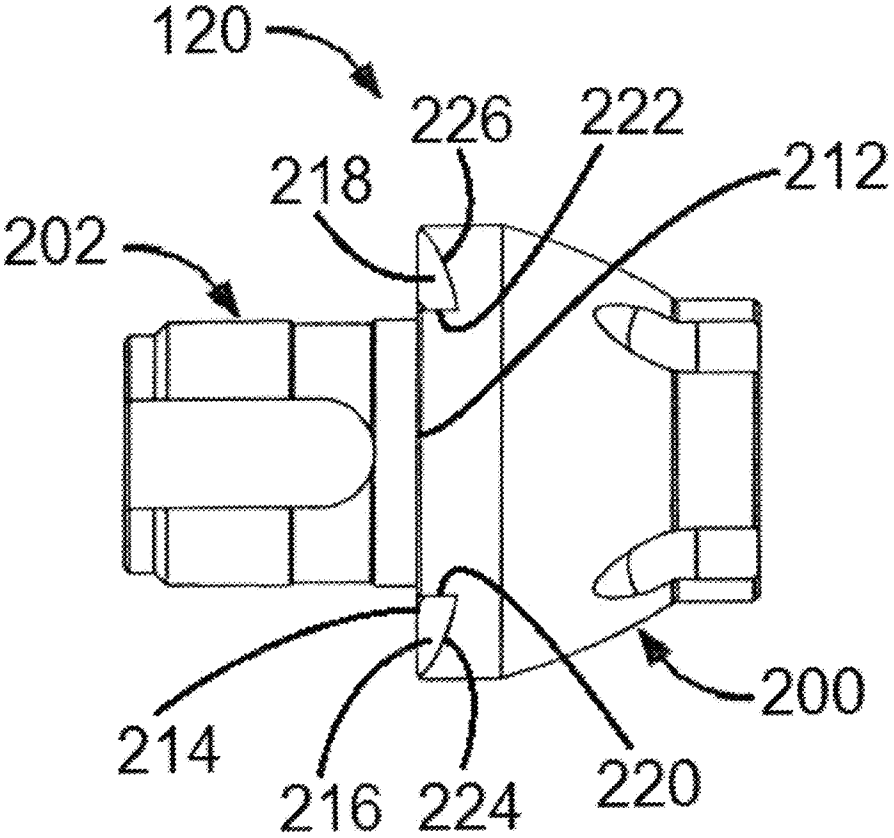
FIG. 19A is a top elevation view of the fifth embodiment of the bit holder of FIG. 19.

Adjacent the tire portion 210 is a tapered portion 212 that ends in a flange 214, shown in FIG. 19A, such as a flat annular flange of the bit holder body 200. The tire portion 210 includes a pair of tapered cutouts 216, 218, or wedge-shaped undercuts, shown in FIG. 19, to provide access and leverage for a tool to extract the bit holder 120 from a base block 254. The tapered cutouts 216, 218 are formed into the tire portion 210 and extend from the flange 214 subjacent to the tire portion 210. The tapered cutouts 216, 218 include a pair of parallel flat vertical inner surfaces 220, 222, respectively, and a pair of flat tapered top surfaces 224, 226, respectively, shown in detail in FIG. 19A. The outer edge of the flat tapered top surfaces 224, 226 is each arcuate in shape to follow the periphery of the tire portion 210. A plurality of notches 228, 230, 232, shown in FIGS. 18 and 20, are formed into the bit holder body 200 and extend from the flat annular top surface 206 through the upper body portion 204 and the middle portion 208, terminating at a point within the middle portion 208. The notches 228, 230, 232 provide access and leverage for a tool to extract, or knock out, the bit or tool 122 from the bit holder body 200 and/or areas in which to spot weld the bit holder 120 to the tool 122.

The shank 202 of the fifth embodiment, shown in FIGS. 19 and 20, axially depends from the flange 214 of the bit holder body 200. The bit holder body 200 and the shank 202 are axially aligned about a bit holder bore 171 that extends from the flat annular top surface 206 of the bit holder body 200 to a distal end 234 of the shank 202. The shank 202 comprises an increased diameter top segment 236 that axially extends from the flange 214. A decreased diameter mediate segment 238 is subjacent to the increased diameter top segment 236. The decreased diameter mediate segment 238 can have a generally cylindrical shape, an arcuate shape, or can be tapered towards the increased diameter top segment 236 or towards the distal end 234 of the shank 202. A slot 240 extends from an upper termination 242 in the decreased diameter mediate segment 238 to the distal end 234 of the shank 202. Subjacent the decreased diameter mediate segment 238 is a lower segment 244 that axially extends to a decreased diameter distal segment 246. The decreased diameter distal segment 246 axially extends from the lower segment 244 to the distal end 234 of the shank 202 and is generally C-shaped when viewed from the distal end 234.

To assemble the combination bit and bit holder of the fifth embodiment, the finished unitary tool 122 can then be fitted into the bit holder 120 by one of three different techniques. The tool shank 156 can be press fit into the bit holder bore 171 of the bit holder 120 at room temperature, the tool shank 156 can be frozen and press fit or slip fit into the bit holder bore 171 of the bit holder 120, or the bit holder body 200 can be heated to expand the bit holder bore 171 to develop a shrink fit between the tool shank 156 of the tool 122 and the bit holder bore 171 of the bit holder 120. The rear annular flange 154 of the tool body 124 is then spot welded to the nose of the bit holder 120 at a plurality of locations. In this fifth embodiment, the rear annular flange 154 is spot welded at three locations 248, 250, 252 in the forward notched positions 228, 230, 232 of the bit holder 120, as shown in the cross-sectional view of FIG. 18. In alternate embodiments, the rear annular flange 154 can be continuously welded to the bit holder 120, having a weld area that is continuous for 360° around the rear annular flange 154, the rear annular flange 154 can be incrementally welded to the bit holder 120, having a plurality of spot welds at incremental locations around the rear annular flange 154, or the combination bit and bit holder can be free of any weldment altogether.

The bit holder 120 is then fitted into a base block bore 256 of the base block 254. When assembled, slot 240 allows the bit holder shank 202 to radially compress when inserted into the base block bore 256 of the shortened front end of the base block 254, forming an interference fit between the shank 202 and the base block bore 256. The force between the diametrically contracted shank 202 of the bit holder 120 and the base block bore 256 maintains and retains the bit holder 120 in the base block 254.

While the present disclosure has been described in connection with certain embodiments, it is to be understood that the present disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit/bit holder for road milling, mining, and trenching machinery comprising:
- a body of rounded shape having an upper end and a lower end, wherein the upper end is diametrically smaller than the lower end and wherein a substantial portion of the body is solid;
- a generally cylindrical shank extending from the lower end of the body, wherein the shank is hollow and includes at least one axially oriented elongate slot through a sidewall of the shank;
- an insert mounted in a bore axially extending in the upper end of the body; and
- a receiving cup mounted in the insert, the receiving cup configured to receive a bit and have a ductility that provides impact absorption to the bit.

2. The bit/bit holder of claim 1, wherein the bit includes a diamond topped distal tip and one of a flat top surface and a generally conical top surface, and wherein the bit is mounted in the receiving cup.

3. The bit/bit holder of 1, the receiving cup comprising a steel cup comprising a bottom portion and an annular flange extending upwardly from a circumference of the bottom portion, the annular flange defining a hollow forward portion of the receiving cup configured to receive the bit.

4. The bit/bit holder of claim 3, the bottom portion of the receiving cup comprising one of a first predetermined thickness and a second predetermined thickness, the first predetermined thickness less than the second predetermined thickness.

5. The bit/bit holder of claim 1, wherein the insert includes a top having a central cylindrical bore and a complementary shaped sidewall for matingly fitting in a generally cylindrical sidewall of the bore of the upper end of the body, the receiving cup receivingly retained in the central cylindrical bore of the insert.

6. The bit/bit holder as defined in claim 5, wherein the bit comprises a base made of one of steel and tungsten carbide.

7. The bit/bit holder of claim 1, wherein the bit includes at least one of a polycrystalline diamond layer, a polycrystalline diamond coating, an industrial diamond coating, and an industrial diamond layer.

8. The bit/bit holder of claim 1, wherein the insert is made of at least one of steel and tungsten carbide.

9. The bit/bit holder of claim 8, wherein said insert includes an annular top ring of hard protective material.

10. The bit/bit holder of claim 9, wherein the annular top ring is made of tungsten carbide.

11. The bit/bit holder of claim 1, wherein the insert is press fit in the bore of the upper end of the body.

12. The bit/bit holder of claim 1, wherein the insert is brazed in the bore of the upper end of the body.

13. The bit/bit holder of claim 1, wherein the insert is shrink fit in the bore of the upper end of the body.

14. The bit/bit holder as defined in claim 1, wherein the at least one axially oriented elongate slot has a distal termination adjacent a distal end of the shank and a forward termination adjacent a forward end of the shank, the at least one axially oriented slot being retained internally within the sidewall of the shank.

15. The bit/bit holder as defined in claim 1, wherein the shank comprises:
- a first tapered portion axially extending from a stepped shoulder adjacent a distal end of the shank;
- an annular shoulder axially extending from the first tapered portion;
- a second tapered portion axially extending from the annular shoulder; and
- a generally cylindrically upper portion axially extending from the second tapered portion, the upper portion subjacent the lower end of the body.

16. The bit/bit holder as defined in claim 1, wherein the bore axially extends a predetermined distance from the upper end toward the lower end of the body, and wherein the predetermined distance is less than a distance from the upper end to the lower end of the body.

17. The bit/bit holder as defined in claim 1, wherein the bore comprises one of a cylindrical bore and a radially declining tapered bore.

18. The bit/bit holder as defined in claim 1, wherein the bore comprises a slight draft angle taper.

19. A tip assembly for an attack tool comprising:
- a diamond coated tungsten carbide tip;
- a ductile metal receiving cup comprising a bottom portion and an annular flange extending upwardly from a circumference of the bottom portion, the annular flange defining a hollow forward portion of the receiving cup configured to receive the tip; and
- a tungsten carbide insert configured to receivingly retain the receiving cup.

20. The tip assembly of claim 19, the bottom portion of the receiving cup comprising one of a first predetermined thickness and a second predetermined thickness, the first predetermined thickness less than the second predetermined thickness.

21. A unitary bit/holder assembly comprising:

a steel holder comprising a body portion and a shank portion extending from the body portion;

the body portion comprising an axially extending annular flange defining a forwardmost portion;

the annular flange comprising an outwardly tapered inner surface;

a reverse tapered tungsten carbide insert comprising a forward end having a recess, the insert complementarily affixed in an interior of the annular flange;

a receiving cup comprising a bottom portion and an annular flange extending upwardly from a circumference of the bottom portion, the annular flange defining a hollow forward portion of the receiving cup, the receiving cup affixed in the recess of the insert; and a diamond coated tip affixed to the hollow forward portion of the receiving cup, the receiving cup configured to provide greater interference between both the tip and the receiving cup and the receiving cup and the insert than the interference between the tip and the insert alone.

22. The unitary bit/holder assembly of claim 21, the bottom portion of the receiving cup comprising one of a first predetermined thickness and a second predetermined thickness, the first predetermined thickness less than the second predetermined thickness.

* * * * *